US005735571A

United States Patent [19]

Colondona

[11] Patent Number: 5,735,571

[45] Date of Patent: Apr. 7, 1998

[54] ORTHOPEDIC BEACH AND RELAXING CHAIR

[76] Inventor: Alexander Vincent Colondona, 1536 Huntington Tpke., Trumbull, Conn. 06611

[21] Appl. No.: 606,457

[22] Filed: Mar. 4, 1996

[51] Int. Cl.[6] ..... A47C 4/00

[52] U.S. Cl. ..... 297/35; 297/40; 297/69

[58] Field of Search ..... 297/16.1, 19, 24, 297/35, 39, 40, 41, 45, 50, 69, 428, 410, 423.2, 423.24

[56] References Cited

U.S. PATENT DOCUMENTS

| | | | |
|---|---|---|---|
| 2,591,284 | 4/1952 | Oden | 297/35 |
| 3,154,344 | 10/1964 | Stableford | 297/40 X |

FOREIGN PATENT DOCUMENTS

| | | | |
|---|---|---|---|
| 191572 | 10/1956 | Austria | 297/35 |
| 44568 | 1/1982 | European Pat. Off. | 297/69 |
| 1101714 | 10/1955 | France | 297/35 |
| 1918865 | 8/1970 | Germany | 297/69 |

*Primary Examiner*—Laurie K. Cranmer
*Attorney, Agent, or Firm*—Richard T. Holzmann

[57] ABSTRACT

A portable foldable relaxing chair orthopedically designed to reduce stress in either the supine or prone position capable of allowing one to assume an orthopedic posture of weightlessness at about 127° in the supine position and significantly reducing stress to the lower back at approximately 185° in the prone position while supporting the sides of the face and neck with a head piece made of two foam supports. A head and foot rest is provided which are attached through pivots capable of lengthening and shortening to suit the user's height and of angular positioning for proper support and comfort. The chair comprises a back and seat panel of any suitable fabric which is replaceable inserted into side frames attached by hinges. Arm rests are attached by fixed pivots to the back frames which pivots support front legs hinged to rear legs which are in turn attached by seat adjusting guide assembly angles along the outer seat frames. Said assemblies allow for slidably raising and lowering the legs by a knob and clamp arrangement while remaining seated.

8 Claims, 4 Drawing Sheets

ORTHOPEDIC BEACH AND RELAXING CHAIR

BACKGROUND

This invention relates to a portable relaxing chair orthopedically designed to reduce stress when the user is in either the prone or supine position.

Conventional portable relaxing chairs are of a number of different types. For example, U.S. Pat. No. 4,606,086, issued to Rowland, discloses a pool lounge chair improvement wherein an opening is provided in the portion supporting the user's upper body so that a user can lie on his or her stomach, i.e., the prone position, and place their face over the opening and read through the opening a book or magazine held or resting on the opposite side of the portion supporting the user.

In U.S. Pat. No. 4,941,222, Prager discloses a portable lounge chair with support in both the abdomen and back positions. This lounge is designed to give support when lying on one's back by using preferably convex shaped slidable supports, which may also be cylindrical, on the top surface of the lounge secured by adjustable parallel bands. It is also adjustable to provide support for users of different sizes and shapes.

U.S. Pat. No. 5,121,969 issued to Schroeder discloses a head rest designed to be portable and adaptable for use with existing lounges being easily installed without tools. It is extendible and reversible and is installed by pushing in, over and under the existing slats on the lounge. This adjustable head rest, though in a fixed position, allows a person to lie on their stomach without the necessity of turning their head.

In U.S. Pat. No. 5,222,779, Johnson discloses a chaise lounge for supporting a prone person and accommodating the person's face and arms. In general, this object is accomplished by a chaise lounge having a generally triangular opening head support section for accommodating the person's face, and an area of reduced width for accommodating the person's arms so as to allow, for example, the user to hold a book underneath the lounge while lying in the prone position. The head rest is T-shaped with a soft removable cover and may be inflatable.

Since portable lounge and relaxing chairs due to their very nature need to be of light weight in order to be carried by one person to the beach, for example, they cannot be of the substantial construction usually required to provide adequate support for the body. Consequently, the end purpose of relaxation is often defeated by the muscular stress-inducing nature of the construction of the chair itself.

It is desirable, therefore, to have a portable relaxing chair which overcomes these stress problems by applying sound chiropractic principles while maintaining the light weight nature of the material of construction. Thus, an object of this invention is to provide a portable relaxing chair which presents a solution to the above-cited problem by incorporating an orthopedic posture of weightlessness at about 127° supine position and significantly reducing stress to the lower back at approximately 185° in the prone position while supporting the face and neck with a head piece made of foam.

Another object of this invention has been to adapt the design of a chiropractic table to that of a foldable and portable chair for the beach and similar applications.

A further object is to provide points of comfort for the face and cheek bones specifically constructed so as to maximally reduce pressure at those sites in the prone position.

Yet another object of this invention is to insure maximum support and relaxation at the various fulcrums of the body and the chair. In a sense, it is to effect a oneness with the chair and with the user.

For the foregoing reasons there is a need for a portable relaxing chair that, based on sound chiropractic principles, is structured to minimize the stress-inducing nature of portable chairs and to maximize the relaxation potential while at the same time being of light enough weight to be easily carried.

SUMMARY

The present invention is directed to a portable relaxing chair based on sound chiropractic principles that satisfies these needs. A portable folding reclining chair having features of the present invention comprises a back panel for supporting the upper torso, and a seat panel for supporting the lower torso and lower limbs both having frames on the spaced apart sides thereof, the frames having multiple back cross supports, the two panels being connected by frame hinges. A pair of arm rests for supporting the upper limbs is joined to the back panel frame by stationary arm rest pivots; pivotally connected to the arm rests by the stationary arm rest pivots in contact with the back panel frame is a pair of spaced apart parallel front legs having front leg cross supports and hingedly coupled to the rear legs. The pair of spaced apart parallel rear legs, having rear leg cross supports and having fixed seat stops so positioned as to limit the maximum movement of the front legs, are fixedly connected to the seat panel frame by a mounting angle of a seat adjusting guide assembly on each side and spaced apart therefrom and slidably connected by the seat adjusting guide mounted on the seat panel frame at a forward portion of the seat panel frame to said front legs. Thus, the chair can be easily altered into a lounge providing an orthopedic posture of weightlessness at about 127° in the supine position and significantly reducing stress to the lower back at approximately 185° in the prone position while supporting the face and neck with a foam head piece.

A head rest is pivotally mounted at the top of the back panel on a head rest frame having cloth head rest sleeves over foam (not shown) and connected through a head rest pivot which is rigidly joined to the back cross supports by head rest extension bars passing through a head rest locking clamp and head rest extension bar guides allowing adjustments in length to suit the height of the user and adjustments in angle to suit the comfort of the user. This head rest configuration comprising two spaced apart foam cylinders provides points of comfort for the face and cheek bones specifically constructed so as to maximally reduce pressure at those sites when in the prone position. A foot rest frame having a foot rest sling, for supporting the feet, is pivotally mounted at the bottom of the seat panel and connected through a foot rest pivot which provides advantages similar to those of the head rest pivot and which is rigidly joined to the seat cross supports by foot rest extension bars passing through a foot rest locking clamp and foot rest extension bar guides. The foot rest can also be pivoted downwards to allow comfortable use when in the chair configuration.

The inside portion of the back and seat panel frames have slot-like openings therein for receiving and holding back (not shown) and seat panel retaining bars to hold the back and seat panel fabric in place. These retaining bars may be removed thereby allowing easy removal of the fabric for cleaning or replacement. The front and rear legs further comprise pivoting feet for maintaining stability, especially on uneven surfaces, as the configuration and position of the chair is altered. The seat adjusting guide assembly further comprises a seat adjusting guide clamp controlled by a seat adjusting guide knob for limiting the movement of the seat panel and thereby the movement of the back panel.

The pivots each further comprising a stationary mold and a pivoting mold, which latter mold has mating holes spaced apart in 5° increments therein for receiving the position locking pin of the stationary mold said molds being joined together by an elongated and threaded metal shoulder bolt of said pivoting mold fastened to said stationary mold having a female threaded hole therein, said shoulder bolt having beneath its head a compression spring with a spring cover both within the handle for pivot position locking and for forcing said molds together when the pulled handle allowing the resetting of position locking pin is released, each mold having a pair of matching holes therein for receiving the both ends of a pair of torsion springs adapted to snap the pivoting mold back to its normally disposed position relative to said stationary mold.

Said stationary mold and pivoting mold each having a pair of holes therein on the bottom side and top side respectively said bottom side holes of the stationary mold for receiving said head rest extension bars for passing through a head rest locking clamp and head rest extension bar guides and said top side holes of the pivoting mold for receiving said head rest frame said bars and frame being held in position by set screw pairs, thus allowing for adjustment of their position to provide maximum comfort to a user.

Preferred materials of construction are chosen to provide the lightest weight consistent with strength and resistance to wear and the elements. Said frames and legs are preferably made of commercial, high-strength aircraft grade tubular aluminum for light weight, strength and corrosion resistance. The various extension bars may be fabricated of rod. Said back panel and seat panel consists of any suitable fabric selected for its strength, wear and weather resistance, comfort and appearance. The fabric would optimally be selected from those strong resilient synthetic fabrics often used in outdoor furniture; cost would be a major consideration. For a more luxurious application, leather may be selected.

BRIEF DESCRIPTION OF THE DRAWINGS

The above and other objects, features and advantages of the present invention will be more clearly understood from the following detailed description and appended claims taken in conjunction with the accompanying drawings, in which:

DESCRIPTION OF THE PREFERRED EMBODIMENT

Figure 1:
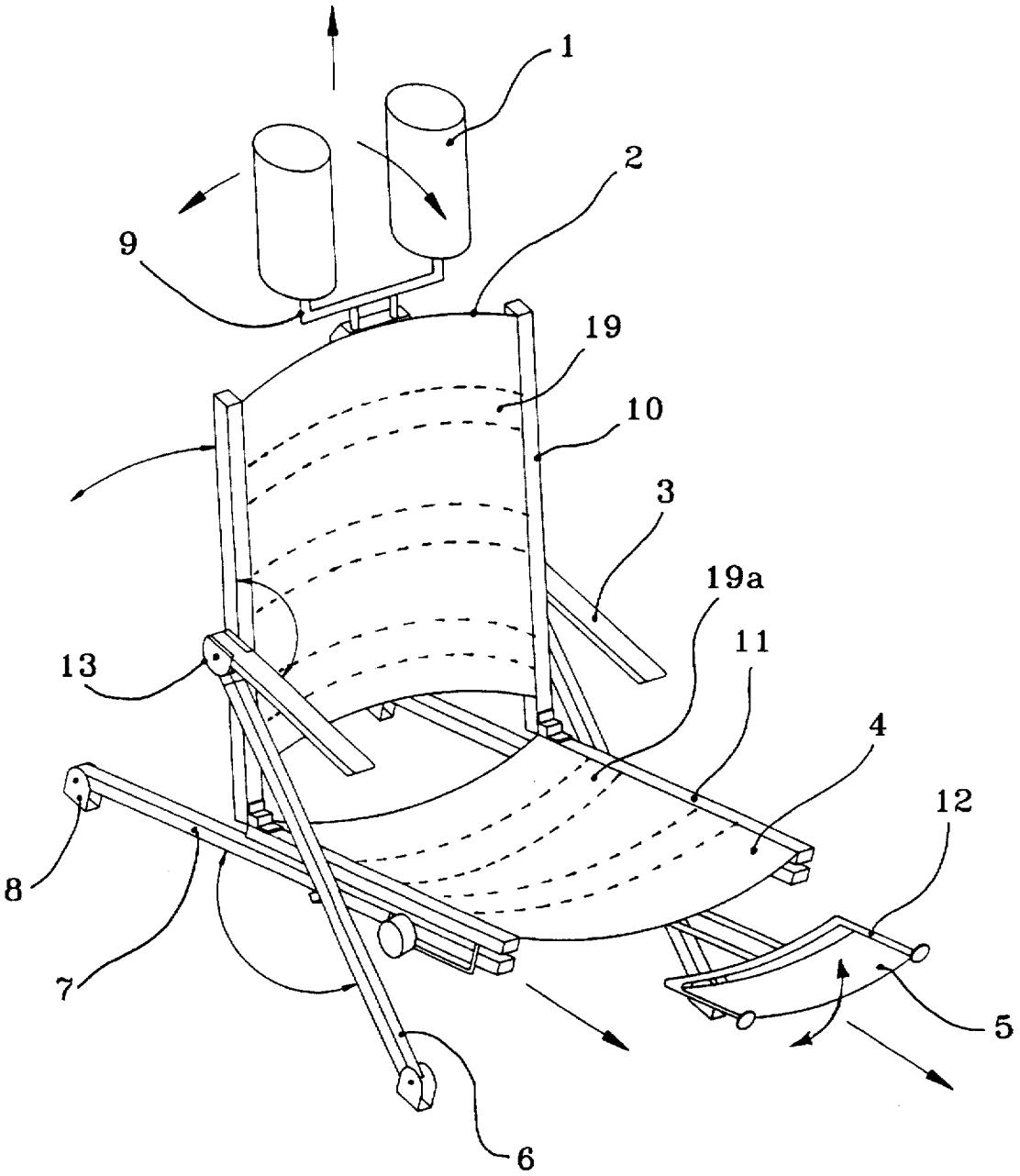
FIG. 1 is a perspective view of the orthopedic beach and leisure relaxing chair.
Figure 2:
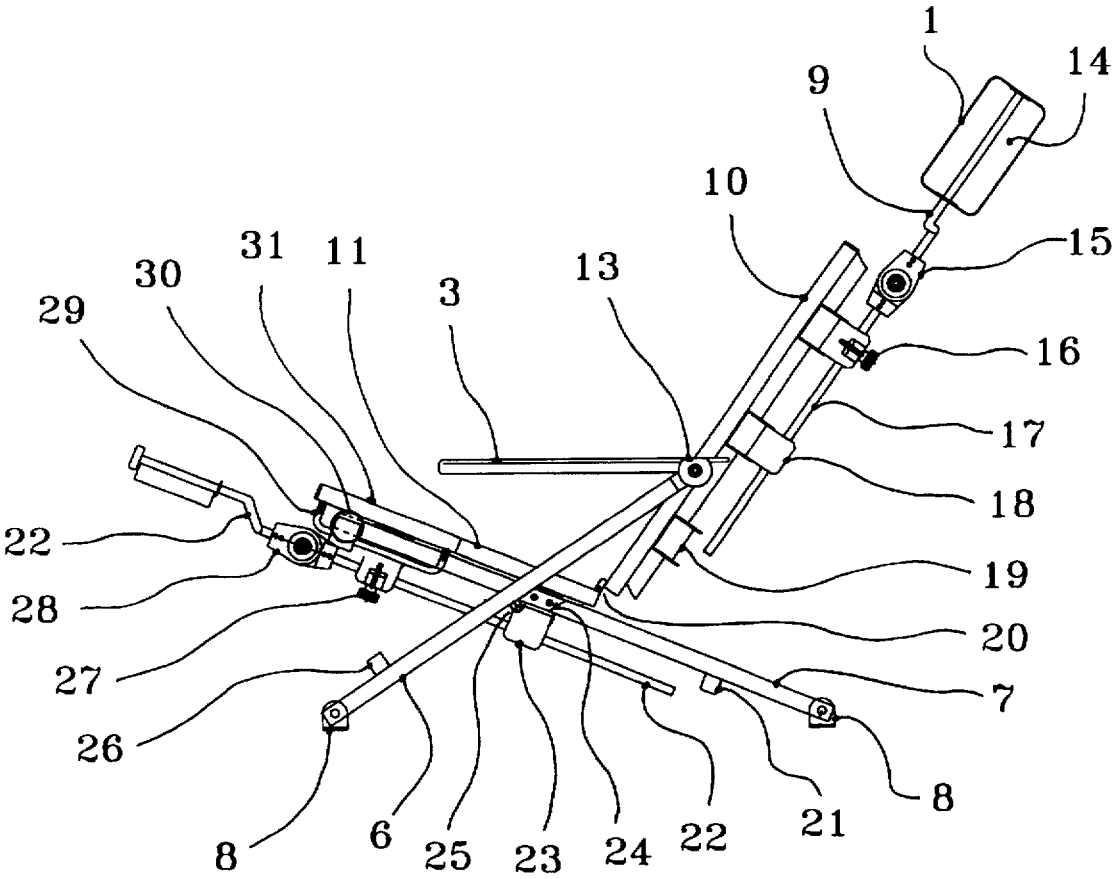
FIG. 2 is a side view of the orthopedic beach and leisure relaxing chair.

The preferred embodiment of the portable orthopedic relaxing chair is illustrated in FIGS. 1 and 2. The front legs 6 and rear legs 7 provide base support and are preferably constructed of commercial high-strength aircraft grade aluminum for light weight, strength and resistance to corrosion, although other materials may be used; all properties desirable in portable furniture. The legs along with the rest of the chair are designed to fold-up for easy storage and transport.

The back panel frame 10 and seat panel frame 11 may also be made of aircraft grade aluminum. The back panel frame 10 and seat panel frame 11 are connected at two pivot points which are identified as seat frame hinges 20. Each side of the seat panel frame 11 near its front is provided with a seat adjusting guide 29 attached to the rear legs 7 for allowing the seat panel frame 11 to slide forward or backward whereby the back panel frame 10, attached thereto, is lowered or raised respectively as are the front legs 6 and rear legs 7. The front legs 6 and the rear legs 7 are attached by leg frame hinges 25. The back panel 2 and seat panel 4 are made of any type of suitable fabric. The fabric is held in place by means of a seat panel retaining bar 33 as the rod in a rod in groove mechanism incorporated in the back panel frame 10 and the seat panel frame 11 on both sides thereof. This allows many types of material to be used and can be changed by the owner. Thus, for use in a library or exercise room, the fabric can easily be upgraded to leather, which indoor embodiment may have headphones for meditation and relaxation.

Figure 3:
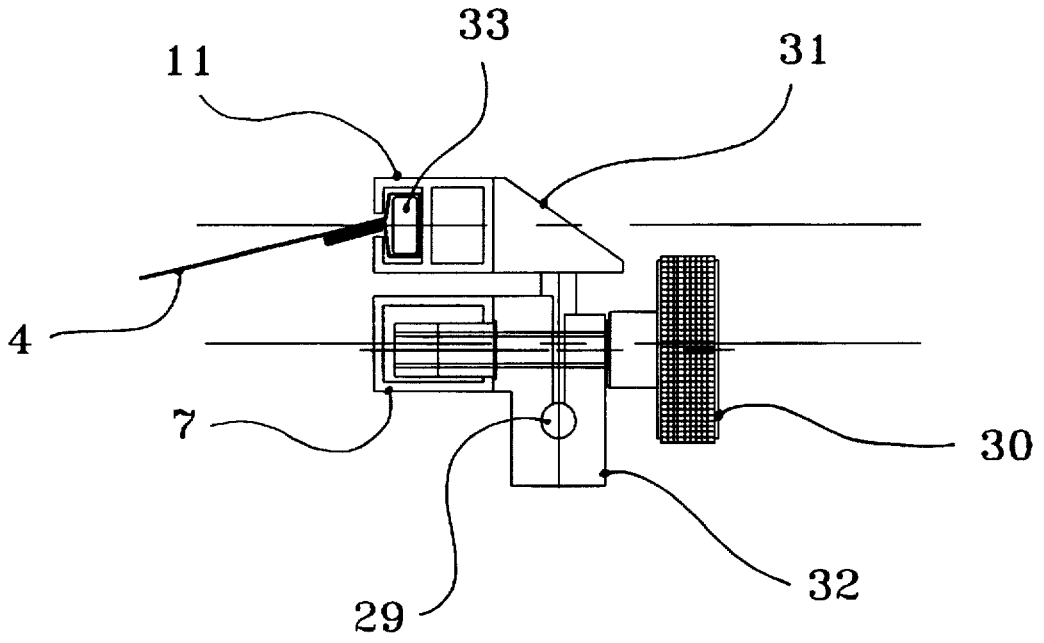
FIG. 3 is a cross sectional view of the seat adjusting guide.
Figure 4:
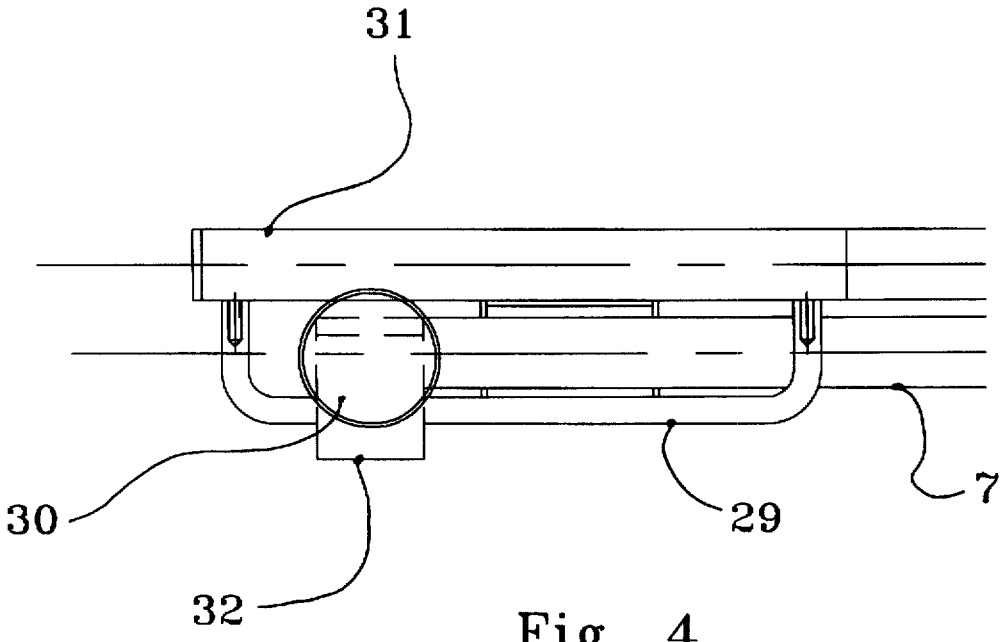
FIG. 4 is a side view of the seat adjusting guide.
Figure 5:
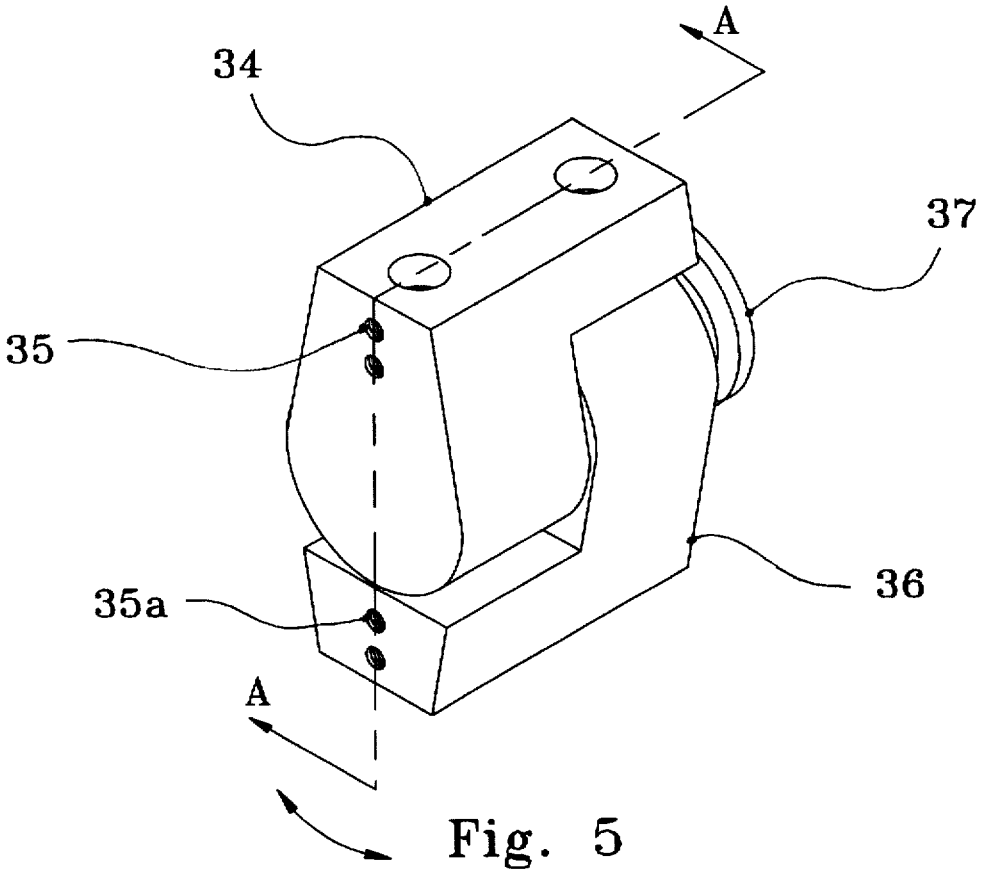
FIG. 5 is a perspective view of the head and foot rest pivots.
Figure 6:
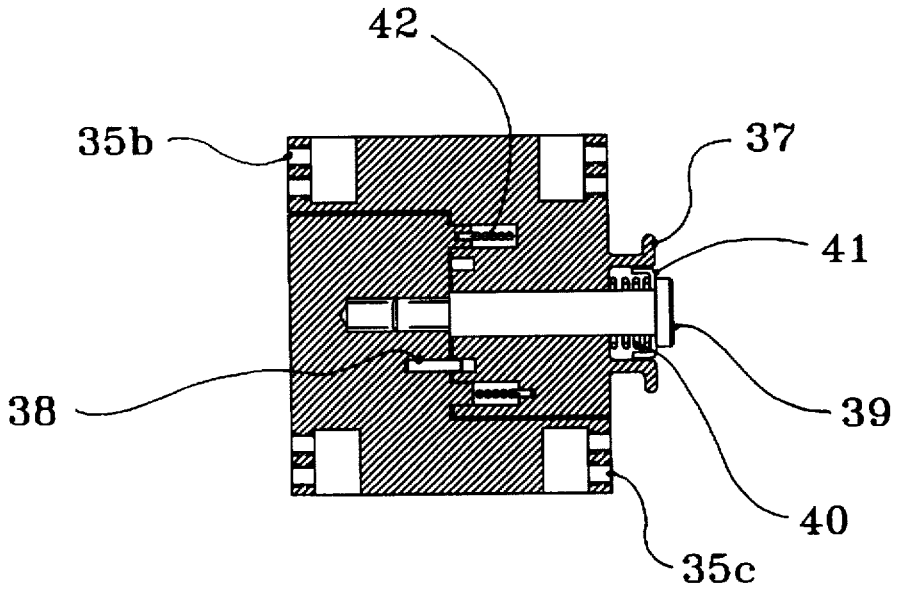
FIG. 6 is a cut view of the stationary and pivoting molds of the head and foot rest pivots of FIG. 5 as joined.

Shown in FIGS. 3 and 4 are the details of the seat adjusting guides 29 which are attached to the rear legs 7 by the seat adjusting guide mounting angles 31. Movement of the seat panel frame 11, which movement necessarily moves the back panel frame 10 for changing the chair into a lounge and vice versa, is effected by loosening and then tightening the seat adjusting guide clamp 32 surrounding the seat adjusting guide 29 by means of the seat adjusting knob 30 allowing back and forth sliding movement of about 6" to 8" to a maximum distance as is prevented by the fixed seat stop 24. Also shown in FIG. 3 is ahe seat panel retaining rod 33 for holding the fabric of the back 2 and seat 4 panels in their frames 10 and 11 respectively.

The head rest 1 consists of two spaced apart padded cylinders which are designed to cradle the head. These pads are adjustable to support the head while in a normal upright or reclined seating position. The head rest is so designed to allow reading while in the prone position by supporting the head along the sides of the face without obstructing vision. This head rest is also similar to that of the chiropractic table so that the head in the prone position has no stress to the neck muscles. It thereby makes reading at the beach easier and more comfortable. The padded cylinders of the head rest are made of a suitable foam into which the head rest frame 9 extends and the foam is covered with cloth head rest sleeves 14. The head rest is connected through a head rest pivot 15 on head rest extension bars 17 passing through two head rest extension bar guides 18, the upper one of which embodies the head rest locking clamp 16. By pulling outward on the head rest pivot 15 handle, the pin is disengaged while pin-loading allows locking into a new position. Thus, the head rest 1 can be moved upwards and downwards to accomodate users of varying sizes, while capable of movement forward, backward and sideways to minimize stress by allowing optimum positioning of the head.

To provide greater structural integrity, the back panel frame 10 has attached thereto back cross supports 19 as do the rear legs 7 having rear leg cross supports 21 and the front legs 6 having front leg cross supports 26. In addition, the front legs 6 and rear legs 7 have stationary pivoting feet 8. Seat panel frame 11 similarly has cross supports (not shown).

The foot rest sling 5 attached to the foot rest frame 12 is adjustable to accommodate individuals of differing heights.

This is accomplished in a similar fashion to that of the head rest 1 in that the foot rest frame 12 passes through the foot rest pivot 28 on the foot rest extension bars 22 which in turn go through the foot rest locking clamp 27 and the foot rest extension bar guides 23. This configuration allows the foot rest sling 5 to be folded up sufficiently to allow the user to sit in the normal chair position.

The arm rests 3 provide support not only when used in the regular seating manner but also in the prone position. To accomplish this, the arm rests are attached to the back panel frame 10 on both sides by stationary arm rest pivots 13 which are also connected to the front legs 6 at the end opposite from the pivoting feet 8.

The pivots 15 and 28 each further comprising a stationary mold 34 and a pivoting mold 36, mold 36 having mating holes spaced 5° apart therein for receiving position locking pin 38 of mold 34 said molds being joined together by an elongated and threaded metal shoulder bolt 39 of said pivoting mold 36 fastened to said stationary mold 34 having a female threaded hole therein, said shoulder bolt 39 having beneath its head a compression spring 40 and spring cover 41 for pivot position locking within handle 37 for forcing said molds together when pulled handle 37 allowing the resetting of position locking pin 38 is released, each mold having a pair of matching holes therein for receiving the both ends of a pair of torsion springs 42 adapted to snap said pivoting mold 36 back to its normally disposed position relative to said stationary mold 34.

In the case of the head rest 1 said molds 34 and 36 have a pair of holes therein on the bottom side and top side respectively said bottom side holes of said stationary mold 34 for receiving said head rest extension bars 17 for passing through a head rest locking clamp 16 and head rest extension bar guides 18 and said top side holes of the pivoting mold 37 for receiving said head rest frame 9 said bars 17 and frame 9 being held in position by set screw pairs 35. The foot rest pivot 28 operates in a similar manner.

In operation, the seat is attached to the rear legs at the sides of the seat towards its front. The seat adjusting guide allows the seat to slide back and forth about 6"–8". The back attaches to the rear legs about 6" from the hinges which are fixed points.

As a person sitting in the chair leans back, the seat is pushed forward and the chair levels out. The angle of recline can be set by clamping the slider, which is near the front of the chair in a convenient position to the hands, when the chair is in the desired position. The angle of the recline is orthopedically designed to take the stress off the lower back. The benefit of this design is that the person can go from an upright position to full recline and anywhere in-between without getting out of the chair. To return to an upright position, the person simply releases the clamp and leans forward. The person's weight will cause the chair to return to the upright position.

The chair may also be used in the prone position. Care has been taken in the design to insure proper alignment of the head and spine. To this end, the chair opens up 5–10 degrees past 180° degrees. In effect, the chair is designed to have a specific bow when used in the prone position.

To assemble the head rest 15 and foot rest 28 pivots the torsion springs 42 are set in place in their corresponding holes as is the position locking pin 38, these springs and pin are then aligned with their proper receiving holes and said two molds 34 and 36 are placed together whereupon the shoulder bolt 39 is threaded into its female receptacle acting against compression spring 40 for holding the two molds together as well as holding the position locking pin 38 in its neutral position. To change the position of said pivoting mold 36 thereby changing the position of the head rest 15 or foot rest 28, the spring-loaded handle 37 of said pivoting mold 36 is pulled against the force of compression spring 40 thereby freeing the position locking pin 38 and allowing the position to be changed in 5° increments. When resetting said pivoting mold 36 to the neutral position the handle 37 is again pulled and the torsion springs 42 snap said pivoting mold 36 back to the neutral position.

In summary, the advantages of this chair over conventional foldable, portable lounge chairs lie in the ease of changing the chair for supine or prone use while maintaining optimum orthopedic support, the person can go from an upright position to full recline and anywhere in-between without getting up out of the chair, in the nature of the head and foot rests, the angle of the reclined position, the interchangeability of the fabric, and the rotating arms and the base of the chair.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A portable foldable reclining chair comprising:

a back panel for supporting the upper torso having a back panel frame on spaced apart sides thereof, the back panel frame having multiple back cross supports;

a seat panel for supporting the lower torso and lower limbs having a seat panel frame on the spaced apart sides thereof, the seat panel frame having multiple seat cross supports, the seat panel frame attached to the back panel frame by seat frame hinges;

a pair of arm rests for supporting the upper limbs joined to the back panel frame by stationary arm rest pivots;

a pair of spaced apart parallel front legs, having front leg cross supports, pivotally connected to the arm rests by the stationary arm rest pivots in contact with the back panel frame and hingedly coupled to a pair of spaced apart parallel rear legs;

said pair of spaced apart parallel rear legs, having rear leg cross supports and having fixed seat stops positioned to limit the maximum movement of said front legs and said rear legs, fixedly connected to the seat panel frame at a forward portion thereof by mounting angles of a seat adjusting guide assembly on each side slidably adjustable for lowering and raising the level of the chair, said front legs hingedly connected to the outer portion of said rear legs by leg frame hinges forward of the fixed seat stops;

a head rest pivotally mounted at the top of the back panel on a head rest frame having cloth head rest sleeves over foam and connected through a head rest pivot which is rigidly joined to the back cross supports by head rest extension bars passing through a head rest locking clamp and a head rest extension bar guide; and a foot rest frame having a foot rest sling, for supporting the feet, pivotally mounted at the bottom of the seat panel and connected through a foot rest pivot which is rigidly joined to the seat cross supports by foot rest extension bars passing through a foot rest locking clamp and foot rest extension bar guides.

2. The back and the seat panel frames in accordance with claim 1 wherein inside portions of the frames have slot-like openings therein for receiving and holding back and seat panel retaining bars to hold the back and seat panel fabric in place.

3. Said front and said rear legs in accordance with claim 1 further comprising pivoting feet for maintaining stability as the configuration and position of the chair is altered.

4. The seat adjusting guide assembly in accordance with claim 1 further comprising a seat adjusting guide clamp controlled by a seat adjusting guide knob for limiting the movement of the seat panel and thereby the movement of the back panel.

5. Said head and said feet pivots in accordance with claim 1 each further comprising a stationary mold and a pivoting mold, said pivoting mold having mating holes spaced 5° apart therein for receiving a position locking pin of said stationary mold said both molds being joined together by an elongated and threaded metal shoulder bolt of said pivoting mold fastened to said stationary mold having a female threaded hole therein, said shoulder bolt having beneath its head a compression spring for pivot position locking and a spring cover within a handle for forcing said molds together when said handle is pulled allowing the resetting of the thereby released position locking pin, each mold having a pair of matching holes therein for receiving the both ends of a pair of torsion springs adapted to snap said pivoting mold back to its normally disposed position relative to said stationary mold.

6. Said stationary mold and said pivoting mold in accordance with claim 1 having a pair of holes therein on the bottom side and top side respectively said bottom side holes of said stationary mold for receiving said head rest extension bars for passing through the head rest locking clamp and the head rest extension bar guides and said top side holes of said pivoting mold for receiving said head rest frame said bars and said frame being held in position by set screw pairs.

7. The back panel and the seat panel in accordance with claim 1 consisting of any suitable fabric selected for its strength, wear and weather resistance, comfort and appearance.

8. The frames and said legs in accordance with claim 1 are preferably made of commercial, high-strength aircraft grade aluminum.

* * * * *